United States Patent [19]

Giometti

[11] Patent Number: 5,042,312

[45] Date of Patent: Aug. 27, 1991

[54] DUAL SHOCK ABSORBER STARTER DRIVE

[75] Inventor: Paul F. Giometti, Horseheads, N.Y.

[73] Assignee: Facet Enterprises, Incorporated, Tulsa, Okla.

[21] Appl. No.: 515,631

[22] Filed: Apr. 27, 1990

[51] Int. Cl.[5] ..... F02N 15/06

[52] U.S. Cl. ..... 74/6; 74/7 R; 74/7 C

[58] Field of Search ..... 74/6, 7 R, 7 C

[56] References Cited

U.S. PATENT DOCUMENTS

| | | | |
|---|---|---|---|
| 1,901,267 | 3/1933 | Sekella | 74/6 |
| 2,281,365 | 4/1942 | Martin | 74/7 |
| 2,495,653 | 1/1950 | Digby | 74/7 |
| 2,546,954 | 3/1951 | Tobias | 74/7 |
| 3,181,375 | 5/1965 | Sabatini | 74/6 |
| 3,263,509 | 8/1966 | Digby | 74/6 |
| 3,318,162 | 5/1967 | Sabatini | 74/6 |
| 3,714,834 | 2/1973 | Digby | 74/6 |
| 3,915,020 | 10/1975 | Johnson | 74/6 |
| 4,464,576 | 8/1984 | Williams | 74/7 R |
| 4,627,299 | 12/1986 | Mortensen, Sr. | 74/7 R |
| 4,695,735 | 9/1987 | Tallis, Jr. et al. | 74/7 C X |

FOREIGN PATENT DOCUMENTS

| | | | |
|---|---|---|---|
| 2034077 | 1/1972 | Fed. Rep. of Germany | 74/6 |
| 74138 | 11/1960 | France | 74/6 |

*Primary Examiner*—Lloyd A. Gall

*Attorney, Agent, or Firm*—Remy J. Van Ophem

[57] ABSTRACT

A starter drive for an internal combustion engine having a clutch to provide rotary torque from a starter motor to a pinion gear connectable to a gear associated with an engine. The clutch has means for indexing the pinion gear to engage the gear associated with the engine, means for maintaining the teeth of the clutch engaged during the indexing function, means for automatically separating the clutch teeth when the engine starts and for maintaining separation of the teeth as long as the rotational speed of the pinion gear is greater than a predetermined speed. The starter drive includes two serially arranged resilient members between a driven clutch member and the sleeve on which the starter drive is slidably mounted. The housing is resiliently suspended between the two resilient members.

20 Claims, 1 Drawing Sheet

DUAL SHOCK ABSORBER STARTER DRIVE

BACKGROUND OF THE INVENTION

1. FIELD OF THE INVENTION

The invention is related to a starter drive for internal combustion engines and in particular to a starter drive having increased impact resistance.

2. DESCRIPTION OF THE PRIOR ART

The invention is an improvement of the starter drive such as those taught by Digby in U.S. Pat. No. 3,263,509 and U.S. Pat. No. 3,714,834. These starter drives are slidably disposed on a power shaft connected to a starter motor and are axially displaced along the power shaft to engage a pinion gear with the ring gear of the engine. The starter drives taught by Digby contain an indexing mechanism which rotates the pinion gear in the event that the teeth of the pinion gear fail to mesh with the teeth of the ring gear of the engine as the starter drive is displaced. The indexing mechanism includes a spring or resilient bumper which absorbs the shock when the pinion gear abuts rather than engages the ring gear.

In an alternate arrangement taught by Johnson in U.S. Pat. No. 3,915,020, a bumper spring is applied between the external housing and a drive clutch member which permits the pinion gear to be indexed when it abuts rather than engages the ring gear. Johnson also provides a multi-piece external housing in which two concentric housing members are biased toward each other by an annular resilient member. This resilient member partially absorbs the force resulting from the axial displacement of the clutch and the pinion members by the bumper spring when the pinion gear is indexed into alignment with the ring gear of the engine.

SUMMARY OF THE INVENTION

The invention is a starter drive for an internal combustion engine having a power shaft rotatably connectable to a starter motor. A sleeve is slidably disposed on the power shaft and is rotatable therewith. The sleeve has an input end portion, an output end portion, and an intermediate portion. The intermediate portion has an external helical spline provided therealong. A driving clutch member circumscribes the intermediate portion of the sleeve and has internal helical splines which engage the external helical splines of the intermediate portion. A driven clutch member is slidably journaled to the output end portion of the sleeve. The driven clutch member has one end adjacent to the driving clutch member. A pinion gear is attached to the driven clutch member and is axially movable therewith into and out of engagement with a gear of an engine to be started. A cylindrical housing circumscribes the sleeve, the driving clutch member, and a portion of the driven clutch member. The housing has a closed end slidably attached to the sleeve and an open end circumscribing a portion of the driven clutch member. A cylindrically shaped retainer member is concentrically disposed within the housing. The retainer member has a first end adjacent to the open end of the housing and a radial flange provided at a second end which is opposite the first end. A first abutment is provided within the housing adjacent to the open end and a resilient annular member is compressively disposed between the radial flange of the retainer and the first abutment which produces a force biasing the retainer member in an axial direction towards the closed end of the housing. A second abutment is provided at the first end of the retainer member and is adapted for engagement with the driven clutch member to limit the displacement of the driven clutch member in an axial direction away from the driving clutch member. Resilient means are provided within the housing adjacent to the closed end for biasing the housing relative to the sleeve in a direction away from the intermediate portion. A coil spring is disposed within the housing for producing a force urging the driving clutch member towards the driven clutch member to maintain the first set of teeth provided on the driving clutch member in engagement with the second set of teeth provided on the driven clutch member and for resiliently biasing the driving and driven clutch members, as a unit, towards the second abutment.

A first object of the invention is a starter drive having two shock absorbers.

A second object of the invention is a starter drive having a shock absorber disposed between the housing and the driven clutch member.

Still another object of the invention is the use of a second shock absorber in the form of an annular resilient member disposed within the housing.

Still another object of the invention is the use of an intermediate cylindrical member between the housing and the driven clutch member and a resilient annular bumper disposed between the housing and the intermediate cylindrical member.

Yet another object of the invention is to have the annular bumper member compressively loaded in an axial direction maintaining contact between the intermediate cylindrical member and the driven clutch member when the pinion gear abuts rather than engages the starter gear of the engine to be started.

These and other objects of the invention will become more apparent from a reading of the specification in conjunction with the drawings.

DETAILED DESCRIPTION OF THE INVENTION

Figure 1:
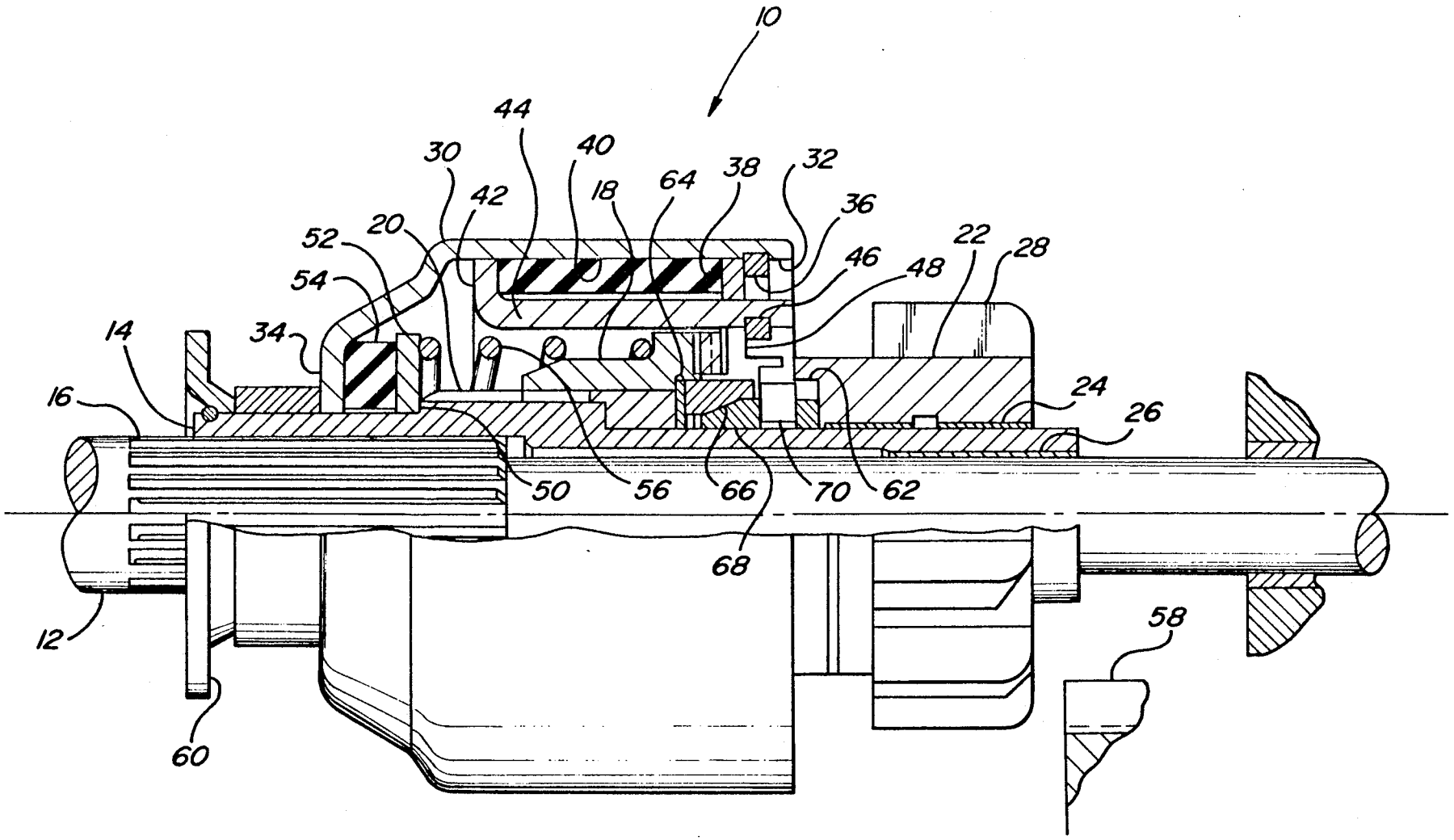
FIG. 1 is a partial cross-sectional side view showing the details of the starter drive incorporating the invention.

Referring to the drawing there is illustrated a starter drive 10 for an internal combustion engine incorporating two shock absorbers. The starter drive 10 is mounted on a power shaft 12 of a starter motor (not shown). The starter drive 10 includes an axially extending sleeve 14 rotatably connected to the power shaft 12 by mating longitudinal splines 16 as is known in the art. The longitudinal splines 16 permit the sleeve 14 to be axially displaced along the power shaft 12. An annular driving clutch member 18 is rotatably mounted on the sleeve 14 and is connected thereto by mating helical splines 20 provided on the internal surface of the driving clutch member 18 and the external surface of the sleeve 14. The mating helical splines 20 are arranged to displace the driving clutch member 18 towards a driven clutch member 22 when the power shaft 12 is rotated by the starter motor in a first direction relative to the driving clutch member 18.

The driven clutch member 22 is slidably journaled on the sleeve 14 by means of a first sleeve bearing 24. The sleeve 14 is slidably supported on the power shaft 12 at the end opposite the longitudinal splines 16 by a second sleeve bearing 26. A pinion gear 28 is fixedly attached to the driven clutch member 22. Preferably the pinion gear 28 is formed integrally with the driven clutch member 22, but the driven clutch member 22 and the pinion gear 28 may be separate elements fixedly attached to each other as shown.

The opposing adjacent faces of the driving clutch member 18 and the driven clutch member 22 are provided with complementary mutually engagable inclined torque transmitting dentil teeth as known in the art. The dentil teeth are of the sawtooth variety to produce a one way overrunning clutch connection.

A cylindrically shaped housing 30 having an open end 32 and a closed end 34 is slidably supported at its closed end 34 on the external surface of the sleeve 14. A first lock ring 36 is seated in an annular groove adjacent to the open end 32 of the housing 30. The first lock ring 36 retains an annular seat 38 for a first annular resilient member 40. The opposite end of the first annular resilient member 40 abuts a radial flange 42 of a cylindrically shaped intermediate retainer member 44. The annular resilient member 40 is preferably made from an elastically deformable material such as rubber and is compressively disposed between the annular seat 38 and the radial flange 42. The intermediate retainer member 44 is concentrically disposed in the open end 32 of the housing 30.

A second lock ring 46 is seated in an annular groove at the end of the intermediate retainer member 44 opposite the radial flange 42. The second lock ring 46 engages a radially extending peripheral lip 48 of the driven clutch member 22. The second lock ring 46 ties the axial displacement of the driven clutch member 22 to the axial displacement of the intermediate retainer member 44.

The sleeve 14 is provided with a radial shoulder 50 which serves as an abutment for an annular retainer 52 slidably journaled on the sleeve 14. A second annular resilient member 54 circumscribes the sleeve 14 and is compressively disposed between the annular retainer 52 and the closed end 34 of the housing 30. The annular resilient member 54 is preferably made from an elastically deformable material such as rubber. A coil spring 56 is compressively confined between the annular retainer 52 and an annular shoulder provided on the driving clutch member 18, as shown, to resiliently bias the driving clutch member 18 in a direction towards the driven clutch member 22.

Means for moving the starter drive 10 towards or away from the gear 58 associated with the internal combustion engine (not shown) may be a conventional solenoid, air, or hydraulic cylinder actuated lever (not shown) connected between the closed end 34 of the housing 30 and a shift collar 60 attached to the sleeve 14.

Means for accomplishing the automatic separation of the dentil teeth of the driving clutch member 18 and the driven clutch member 22, respectively, are arranged in an annular recess 62 of the driven clutch member 22. An annular thrust washer 64 backed by an annular cam 66 abuts a shoulder provided on the driving clutch member 18 adjacent to the driven clutch member 22. The inner surface of the annular cam 66 has a conical shape concentric with the axis of the sleeve 14. A plurality of arcuate centrifugal flyweight members 68 are disposed in the annular recess 62 adjacent to the annular cam 66. Each flyweight member 68 has an inclined surface complementary with and abutting the conically shaped inner surface of the annular cam 66. The flyweight members 68 have guide apertures located near their center of gravity which receive radially disposed guide pins 70. The guide pins 70 are received in radial bores provided in the driven clutch member 22 and secured therein. The guide pins 70 permit radial displacement of the flyweight members 68 but restrain the flyweight members from displacement in an axial or circumferential direction relative to the driven clutch member 22.

In operation, when it is desired to crank the engine, the starter drive 10 is shifted along the power shaft 12 by means of a positioning mechanism connected between the housing 30 and the shift collar 60 to engage the pinion gear 28 with the gear 58 associated with the engine. The starter motor then rotates the power shaft 12 which in turn rotates the pinion gear 28 through the longitudinal splines 16, sleeve 14, driving clutch member 18, and driven clutch member 22. When the engine starts, the gear 58 will rotate the pinion gear 28, the driven clutch member 22, and the driving clutch member 18 at a speed which is faster than the rotational speed of the starter motor and the sleeve 14. As a result, the driving clutch member 18 will be axially displaced by the dentil teeth and the helical splines 20 away from the driven clutch member 22 against the force of the coil spring 56. At the same time, the centrifugal forces will radially displace the flyweight members 68 which will displace the annular cam 66 to follow the axial displacement of the driving clutch member 18. The centrifugal force acting on the flyweight members 68 due to the rotation of the pinion gear 28 by the running engine is sufficient to hold the flyweight members 68 in their radially displaced position preventing the annular cam 66 and the driving clutch member 18 to return to their original position. The radially displaced flyweight members 68 and the resultant axial displacement of the annular cam 66 hold the driving clutch member 18 in a displaced position in which its dentil teeth are physically separated from the dentil teeth of the driven clutch member 22, preventing chattering and wear of the dentil teeth.

Once the engine is started, the starter motor is deenergized and the starter drive 10 is displaced back to its original position, as shown in the drawing in which the pinion gear 28 is disengaged from the gear 58. The rotational speed of the pinion gear 28 and the driven clutch member 22 will rapidly decrease to the point where the centrifugal forces acting on the flyweight members 68 are no longer capable of holding the annular cam 66 and the driving clutch member 18 in the displaced position. The coil spring 56 will then displace the driving clutch member 18 back into engagement with the driven clutch member 22 as shown in the drawing. The driven clutch member 22 is resiliently connected to the housing by the intermediate retainer member 44 and the first annular resilient member 40. Therefore, a portion of the shock generated when the driving clutch member 18 reengages the driven clutch member 22 is absorbed by the first annular resilient member 40, while a second portion of this shock is absorbed by the second annular resilient member 54 between the housing 30 and the sleeve 14.

In the event that the teeth of the pinion gear 28 are not aligned with the teeth of the gear 58 associated with the engine as the starter drive 10 is displaced along the power shaft 12, the teeth of the pinion gear 28 will abut the sides of the mating teeth of the gear 58. The initial shock of the teeth of the pinion gear 28 abutting the sides of the teeth on the gear 58 will be partially absorbed by the coil spring 56 and the second annular resilient member 54. After the initial shock, only the housing 30 and the sleeve 14 are displaced towards the gear 58 by the positioning means.

As the sleeve 14 is advanced, the helical splines 20 rotate the driving clutch member 18 which in turn rotates the driven clutch member 22 and the pinion gear 28 until the teeth on the pinion gear 28 become aligned with the teeth of the gear 58. When the teeth of the pinion gear 28 and the teeth of the gear 58 become aligned, the coil spring 56 and the second annular resilient member 54 urge the driving clutch member 18 and the driven clutch member 22 towards the gear 58 which displaces the pinion gear 28 into engagement with the gear 58.

Because the first annular resilient member 40 was compressively disposed between the housing 30 and the intermediate retainer member 44, the second lock ring 46 is held in physical contact with the peripheral lip 48 of the driven clutch member 22. The rapid axial displacement of the driving and driven clutch members 18 and 22 by the coil spring 56 is absorbed by the first annular resilient member 40 rather than resulting in a hard direct metal-to-metal contact between the peripheral lip 48 of the driven clutch member 22 and the second lock ring 46 as taught by the prior art.

It is to be noted that the first and second annular resilient members 40 and 54 are serially arranged between the driven clutch member 22 and the sleeve 14 with the mass of the housing 30 being suspended therebetween. This arrangement of using two serially arranged resilient members with the mass of the housing suspended therebetween has been found to be more effective in absorbing the impact shocks during engagement of the pinion gear 28 with the gear 58 associated with the engine than the use of the single resilient member as taught by the prior art.

It is not intended that the invention be limited to the specific structure shown in the figure and described in the specification. It is understood that those skilled in the art will be able to make changes or otherwise modify the structure of the starter drive within the scope of the invention as described above and set forth in the appended claims.

What is claimed is:

1. A starter drive for an internal combustion engine having a starter motor and an engine gear by which said engine may be cranked comprising:

a power shaft connected to said starter motor;

a sleeve slidably disposed on said power shaft and rotatable therewith;

a clutch assembly having a pinion gear engageable with said engine gear to crank said engine, said clutch assembly having an engaged state transferring the rotational torque of said starter motor to said engine gear, and a disengaged state when the rotational speed of said pinion gear exceeds the rotational speed of said starter motor in response to the starting of said engine;

a cylindrical housing circumscribing a portion of said sleeve and said clutch assembly, said cylindrical housing having a closed end slidably journaled to said sleeve and an open end, said pinion gear being external to said cylindrical housing;

a first resilient member disposed in said cylindrical housing between said sleeve and said closed end of said housing to absorb the shock when said pinion gear is not aligned with said engine gear; and a second resilient member disposed in said cylindrical housing between said clutch assembly and said cylindrical housing to absorb the shock when said pinion gear is indexed into alignment with said engine gear.

2. The starter drive of claim 1 wherein said clutch assembly has a driving clutch member attached to said sleeve by a helical spline and a driven clutch member slidably journaled on said sleeve and wherein said pinion gear is attached to said driven clutch member, said second resilient member is disposed between said cylindrical housing and said driven clutch member.

3. The starter drive of claim 2 wherein said starter drive includes an intermediate cylindrical member disposed concentrically within said cylindrical housing having a first end engaged with said driven clutch member and an opposite end, and wherein said second resilient member is compressively disposed between said open end of said cylindrical housing and said opposite end of said intermediate cylindrical member.

4. The starter drive of claim 3 further comprising indexing means for rotating said pinion gear when said pinion gear fails to mesh with said engine gear as a result of the displacement of said starter drive along said power shaft towards said engine gear.

5. In a starter drive having a power shaft, a sleeve slidably disposed on said power shaft and rotatable therewith; a driving clutch member connected to said sleeve by mating helical splines, a driven clutch member slidably journaled on said sleeve adjacent to said driving clutch member, said driving and driven clutch members having complementary mutually engagable teeth for transmitting a torque therebetween in one direction, a pinion gear attached to said driven clutch member and rotatable therewith, said pinion gear slidable with said driven clutch member to engage an engine gear, a housing circumscribing said driving clutch member and a portion of said driven clutch member, said housing having a closed end slidably journaled to said sleeve and an open end abuttingly engaging said driven clutch member, means disposed within said housing for resiliently biasing said driving clutch member in engagement with said driven clutch member, means for automatically separating said driving clutch member from said driven clutch member when the rotational speed of said driven clutch member exceeds the rotational speed of said power shaft means for maintaining the separation of said driving clutch member from said driven clutch member as long as the rotational speed of said pinion gear and said driven clutch member exceeds a predetermined value, means disposed between said housing and said sleeve for partially absorbing the shock encountered when said pinion gear fails to mesh with said engine gear when said starter drive is axially displaced, the improvement comprising a second resilient means disposed between said driven clutch member and said housing to absorb the shock encountered when said pinion gear is indexed to engage said engine gear.

6. The improvement of claim 5 wherein said second resilient means comprises:

an intermediate cylindrical member disposed within said housing having a first end engaging said driven clutch member and a second end internal to said housing having a radially extending flange;

a first annular abutment provided adjacent to said open end of said housing; and a resilient annular member compressively disposed in said housing between said radially extending flange and said first annular abutment.

7. The improvement of claim 6 wherein said driven clutch member has a peripheral lip extending radially therefrom, said intermediate cylindrical member has a second annular abutment engaging said peripheral lip to inhibit the axial displacement of said driven clutch member along said sleeve in a direction away from said driving clutch member.

8. The improvement of claim 6 wherein said resilient annular member is a rubber annular member.

9. A starter drive for an internal combustion engine comprising:

a power shaft;

a sleeve slidably disposed on said power shaft and rotatable therewith, said sleeve having an input end portion, an output end portion, and an intermediate portion, said intermediate portion having external helical splines provided therealong;

a driving clutch member circumscribing said intermediate portion of said sleeve, said driving clutch member having internal helical splines engaging said external helical splines;

a driven clutch member slidably journaled to said output end portion of said sleeve, said driven clutch member having one end adjacent to said driving clutch member;

a pinion gear attached to an opposite end of said driven clutch member and rotatable therewith, said driven clutch member and said attached pinion gear adapted for axial movement along said sleeve relative to said power shaft into and out of engagement with a gear of the engine to be started;

a first set of teeth provided on one end of said driving clutch member adjacent to said driven clutch member for transmitting a torque in one direction;

a second set of teeth provided on said one end of said driven clutch member engagable with said first set of teeth provided on said driving clutch member to transmit said torque from said driving clutch member to said driven clutch member in said one direction;

a cylindrically shaped housing circumscribing said sleeve, said driving clutch member, and a portion of said driven clutch member, said cylindrically shaped housing having a closed end slidably attached to said input end portion of said sleeve and an open end;

a cylindrically shaped retainer member concentrically disposed within said cylindrically shaped housing, said cylindrically shaped retainer member having a first end adjacent to said open end and a radial flange provided at a second end opposite said first end;

a first abutment provided within said cylindrically shaped housing adjacent to said open end;

a resilient annular member compressively disposed between said radial flange and said first abutment producing a force biasing said cylindrically shaped retainer member in an axial direction towards said closed end of said housing;

a second abutment provided at said first end of said retainer member adapted for engagement with said driven clutch member to limit the displacement of said driven clutch member in an axial direction away from said driving clutch member;

a first resilient means provided within said housing adjacent to said closed end for resiliently biasing said cylindrically shaped housing relative to said sleeve in a direction away from said intermediate portion; and a second resilient means disposed within said cylindrically shaped housing for producing a force resiliently biasing said driving clutch member towards said driven clutch member to maintain said first set of teeth engaged with said second set of teeth and resiliently biasing said driving and driven clutch members as a unit towards said second abutment.

10. The starter drive of claim 9 wherein said driving clutch member is axially displaced from said driven clutch member when said engine starts and the rotational speed of said driven clutch member exceeds the rotational speed of said driving clutch member, said starter drive further comprising means responsive to the rotational speed of said driven clutch member for inhibiting the return of said driving clutch member into engagement with said driven clutch member.

11. The start drive of claim 10 wherein said means for inhibiting the return of said driving clutch member comprises a plurality of flyweight members disposed within an annular recess provided within said driven clutch member, said plurality of flyweight members responsive to the rotational speed of said driven clutch member to be radially displaced by centrifugal forces and an annular cam member axially displaced by the radial displacement of said plurality of flyweight members to engage said driving clutch member, said plurality of flyweight members and said annular cam member prohibiting said driving clutch member from reengaging said driven clutch member.

12. The starter drive of claim 9 wherein said pinion gear is integral with said driven clutch member.

13. The starter drive of claim 9 wherein said first and second sets of teeth are complementary mutually engagable dentil teeth.

14. The starter drive of claim 9 wherein said first abutment comprises an annular ring disposed between said cylindrically shaped housing and said cylindrically shaped retainer member and a first lock ring received in an annular groove provided inside of said cylindrically shaped housing adjacent to said open end.

15. The starter drive of claim 9 wherein said second abutment is a second lock ring received in an annular groove provided adjacent said first end of said cylindrically shaped retainer member which engages said driven clutch member.

16. The starter drive of claim 15 wherein said second lock ring engages one side of a peripheral lip radially extending from said driven clutch member.

17. The starter drive of claim 9 wherein said power shaft has a set of external linear splines which are slidingly engaged by a set of internal splines provided in said sleeve.

18. The starter drive of claim 9 wherein said first resilient means is an annular rubber bumper circumscribing said input end portion of said sleeve between said closed end of said housing and an annular retainer abutting a shoulder provided on said sleeve adjacent to said intermediate portion.

19. The starter drive of claim 18 wherein said second resilient means is a compressed coil spring circumscribing said sleeve between said annular retainer and said driving clutch means.

20. The starter drive of claim 9 wherein said resilient annular member is a rubber annular member.

* * * * *